US006930574B2

(12) United States Patent
Gao

(10) Patent No.: US 6,930,574 B2
(45) Date of Patent: Aug. 16, 2005

(54) GROUND FAULT CIRCUIT INTERRUPTER AGAINST REVERSE CONNECTION ERROR

(76) Inventor: Shaohua Gao, 3 Guang An Road, Zhi Guang Industry District, Liu Shi Twon, Yue Qing, Zhe Jiang (CN)

( * ) Notice: Subject to any disclaimer, the term of this patent is extended or adjusted under 35 U.S.C. 154(b) by 0 days.

(21) Appl. No.: 10/704,855

(22) Filed: Nov. 10, 2003

(65) Prior Publication Data

US 2004/0201438 A1 Oct. 14, 2004

(30) Foreign Application Priority Data

Apr. 11, 2003 (CN) ..... 03 1 16315 A

(51) Int. Cl.[7] ..... H01H 73/00
(52) U.S. Cl. ..... 335/18; 361/42
(58) Field of Search ..... 335/18, 202; 361/42–51

(56) References Cited

U.S. PATENT DOCUMENTS 4,034,266 A * 7/1977 Virani et al. ..... 361/42
4,595,894 A 6/1986 Doyle et al.
5,510,760 A * 4/1996 Marcou et al. ..... 335/18
6,522,510 B1 2/2003 Finlay et al.
2002/0071228 A1 6/2002 Campolo et al.

* cited by examiner

*Primary Examiner*—Lincoln Donovan
(74) *Attorney, Agent, or Firm*—Venable LLP; Jeffrey W. Gluck; Manni Li

(57) ABSTRACT

A ground fault circuit interrupter against RCE suitable for various electrical instruments, equipments and systems fed by electrical power supply is characterized in that an erroneous reverse connection mechanism is included in its load end and the reset button comprises a reverse trip mechanism. When electric power is mistakenly connected to the load ends, the reset button will be always in trip situation and the socket on its upper lid will be kept free of electricity even the reset is attempted unless the error connection is corrected. As compared to prior art, the circuit interrupter of this invention has a simple mechanical trip structure which can effectively prevent equipment damage and personal hazard caused by reverse connection. Of course, it had successfully passed the 6 KV/3 KA electric surge test and is highly anti-moist and anticorrosive.

14 Claims, 15 Drawing Sheets

GROUND FAULT CIRCUIT INTERRUPTER AGAINST REVERSE CONNECTION ERROR

CROSS REFERENCE TO RELATED APPLICATIONS

This application claims priority to Chinese patent application Ser. No. 03 1 163 15.7 filed Apr. 11, 2003.

FIELDS OF INVENTION

The invention related to a ground fault circuit interrupter, and particularly to a ground fault circuit interrupter against reverse connection error (RCE). It is suitable for use in various electrical apparatuses, instruments, devices, equipments and systems fed by power supply.

DESCRIPTION OF RELATED ART

Most electric wire connection devices have a power source input end and a load end for one or more load connections. Between the input and load ends there must be at least one place where the passage of the electric circuit can be detected. Power source wire or current conducting connections are connected at the input end and load end. Manufacturers of electric wire connection apparatus are incessantly adding circuit interrupting devices or systems so as to be able to cut off current of different loads, like household electrical appliances, electrical products of the consumer class and branching circuit. Household bath rooms and kitchens are among the electric supply circuit where ground fault circuit interrupters are especially needed.

In prior art, there is a kind of "ground fault circuit interrupting system (GFCIS)" described in The U.S. Pat. No. 4,595,894, in which a trip mechanism such as trip device enable to reset is triggered to mechanically cut off the electric connection in input and load ends. But under many abnormal conditions, the mechanism used to cut off the circuit will lose its trip capability due to current surge during the cutting off process.

This event mostly happens when the reset button is still pressed down and the result is a trip device without function and a reset without ground fault protection which causes electric appliances damage and endangers human safety.

For the traditional ground fault circuit interrupters (referred to as GFCI hereafter), in addition to connect a load at the wire, it is possible to connect one or more connection points at the proximity of the load. The wire connecting them to the load end is connected by assembly screws and load is connected to the inner socket by a plug. A point worthy of paying attention to is that of the device connecting outside wires, its input wire is connected to the inlet wire end, and its load wire is connected to the load end. Frequently, the otherwise case happens, that is, GFCI is erroneously connected to the outside electric wire, so that the load wire is connected to the input wire end and the power source wire is connected to load end. This condition is known as the reverse connection which makes the circuit interrupting device be reversely connected and which disables the fault protection for the load connection and the power source, without protection, is always directly supplying power to the socket no matter it is in the trip condition or in the normal condition so that the protection is not provided even remaining of fault protection for load connection. This shows that those devices have been made reversely connected by the connecting wires. Also in the prior art, many GFCIs adopt warning measures like warning labels, indicating lights and warning alarms for erroneous reversely connected wires to notify users to correctly make wire connection to the load end. But only warning is not enough and many devices have been connected reversely by mistake and damages been made. Also in the prior art, some GFCIs are equipped with erroneous connection protection devices and when erroneous reverse connection occurs the protection devices do prevent the reset button from effecting the reset, but power source will still be supplied to socket on the upper lid without protection being offered and you can still get electric power even without performing reset by pressing the reset button and this disables the protection of the protective device and results in equipment damage all the same.

SUMMARY OF INVENTION

The object of this invention is to overcome the shortcomings of the protective devices in the circuit interrupters of prior art mentioned above and provides a ground fault circuit interrupter against reverse connection error with a simplest mechanical trip structure for the reset button to solve the problem of protection against reverse connection error, and thus safety can be assured and damage loss can be prevented.

The circuit interrupter of this invention mainly includes: a case composing a base 003, a middle frame 002 and an upper lid 001, a reset button 006 and a test button 007 placed on the upper lid 001, a grounding bracket 004, two input ends and two load ends and two socket static contact conduction parts 005-1, 005-2. The said two input ends respectively have the input end movable contacts 016, 017 connected by wires and two load ends respectively have the load end moveable contacts 018, 019 connected by wires. To the load end there is connected the erroneous reverse connection mechanism and to the reset button there is connected the reverse trip mechanism.

The said middle frame 002 is located separately between the upper lid 1 and the base 003, or is placed within the base 003.

The said erroneous reverse connection mechanism connected to the load end mainly includes two load end connection parts 15-1, and 15-2, two reverse conducting wires 039 and two reverse trip load end conducting springs 034-1 and 034-2. The said two load end connection parts 15-1 and 15-2 are connected to the reverse trip load end conducting springs 034-1 and 034-2 thru the reverse conducting wires 039.

The said reverse trip mechanism on the reset button 006 mainly includes two reverse trip movable contact 033-1 and 033-2, two reverse trip static contact 032-1 and 032-2, the reset trip device 020, the trip winding bracket 021, the trip winding 036 successively placed on the trip winding bracket 021 containing the trip armature 024 inside, the trip armature reset spring 026, the trip winding magnetic pole piece 031 and the reset trip lock pin 025 with the reset lock pin spring 027 inside. The said two reverse trip static contact 033-1 and 033-2 located on each side of said trip winding bracket 021 are placed on the top of the reverse trip load end conducting springs 034-1 and 034-2 thru the reset trip device 020 respectively.

For the circuit interrupter having the structure as described, when electricity comes in thru the two wire connecting screws 010-1 at the input end, if we press down the reset button 006 which moves the reset trip device 020, the circuit interrupter is now in the reset situation, and the input end movable contact 016 and 017 are in contact with the socket contact conducting parts 005-1 and 005-2 thus making the sockets of the interrupter supplied with power for costumer's use. Suppose in the time of usage a ground fault, an over load or a short circuit of a magnitude over 5 mili-ampere occurs, the current surge will excite the trip winding 036 suddenly like a blitz which activates the reset trip device 020 and causes the reset button 006 to trip and separates the input movable contacts 016 and 017 from the socket static contact conducting parts 005-1 and 005-2, which in turn, makes the socket of the interrupter loss of power and all instrument, equipment, and personal safety are being protected. In order to continue the usage, fault must be removed first.

When erroneous reverse connection is made, current will flow from the load end wire connection parts 15-1 and 15-2 and are connected to the springs 034-1 and 034-2 thru wire 039. Now reverse trip load conducting springs 034-1 and 034-2 are in contact with reverse trip movable contacts 033-1 and 033-2 and the reset button 006 is in the trip static situation, but since the reverse trip movable contacts 033-1 and 033-2 are separated from reverse trip static contacts 032-1 and 032-2 by a set distance, this prevents the current flow thru the interrupter and thus prevents the usage of a power with erroneous reversely connected lines and safe guard is assured, as shown in FIGS. 6 and 9.

When power is erroneously connected to the interrupter thru the load end, the outside surface of the interrupter socket is always without electricity because the load end is separated from the socket static contact conducting parts 005-1 and 005-2. If reset button 006 is pressed down, then pin 025 is opened, armature 006-1 within reset button 006 is locked by pin 025 using the resilience of trip iron core reset spring 026, thus reset spring 023 begins to raise, which thru the action of device 020 causes the movable contacts 033-1 and 033-2 to move and the springs 034-1 and 034-2 at the lower end of contacts 033-1 and 033-2 then begin to resile and raise simultaneously. When button 006 raises to the set position but yet not to the reset position, contacts 033-1 and 033-2 touch contacts 032-1 and 032-2 which excites winding 036 to blitz an induced interruption action which in turn causes armature 024 begin to compress reset trip spring 026 and push forward pin 025 to open the pin lock door, thus after the reset spring 026 resiles the reset button 006 trips off, preventing itself to reset and providing assured safety to users as shown in FIG. 9.

As described above, if a power source is erroneously connected to load end of the circuit interrupter and the reset button 006 is operated in order to change it from its former trip condition to reset condition, it will immediately trip off again and cut off the connection of electric source to the socket on the interrupter. Even repeated pressing down on the button 006 still cannot make it enter into the reset state, thus personal hazard and electric appliance damage are prevent from and the life time of interrupter is increased. If the power source is connected to the input end of interrupter and electric current flows to the load end thru the socket static contact conducting parts 005-1 and 005-2, and suppose the user connects one or more connection points near his original load, this will still keep the interrupter operating in normal usage condition and its erroneous reverse connection mechanism would be in a long term open circuit state and will absolutely not affect on the reset and erroneous trip function.

The interrupter of this invention has advantagous effect in that: when the power source is erroneously connected to its load end, its anti-RCE (Reverse connection Error) mechanism composed of said erroneous reverse connection mechanism and reverse trip mechanism can assure that there will always have no electric current flowing thru the socket on the surface of the interrupter and its reset button will be situated in trip condition for long term. The interrupter will refuse to be reset even the reset button is repeatelly pressed down for more than 100 times. Reset can be affected only after the erroneous wire connection is corrected. When the circuit interrupter is in service in normal condition, its anti-RCE mechanism will always situate in "off" condition which will absolutely not affect the normal operation of the device and will truly ensure equipment and personal safe. It had passed successfully the 6 KV/3 KA electric surge test and has excellent anti-moisture and anti-corrosion capability. Its cost is low and is suitable for batch production.

BRIEF DESCRIPTION OF ACCOMPANYING DRAWINGS

FIG. 1-2 is an outside structural view of the circuit interrupter of the invention for input current of 20 amperes.

FIG. 2-1 is an inner structural view of the circuit interrupter for input current of 15 amperes as shown in FIG. 1-1 with its upper lid 001 removed.

FIG. 2-2 is an inner structural view of the circuit interrupter for input of 20 amperes as shown in FIG. 1-2 with its upper lid 002 removed.

FIG. 7 is a schematic view showing the situation when reverse direction conduction is on.

Figure 3:
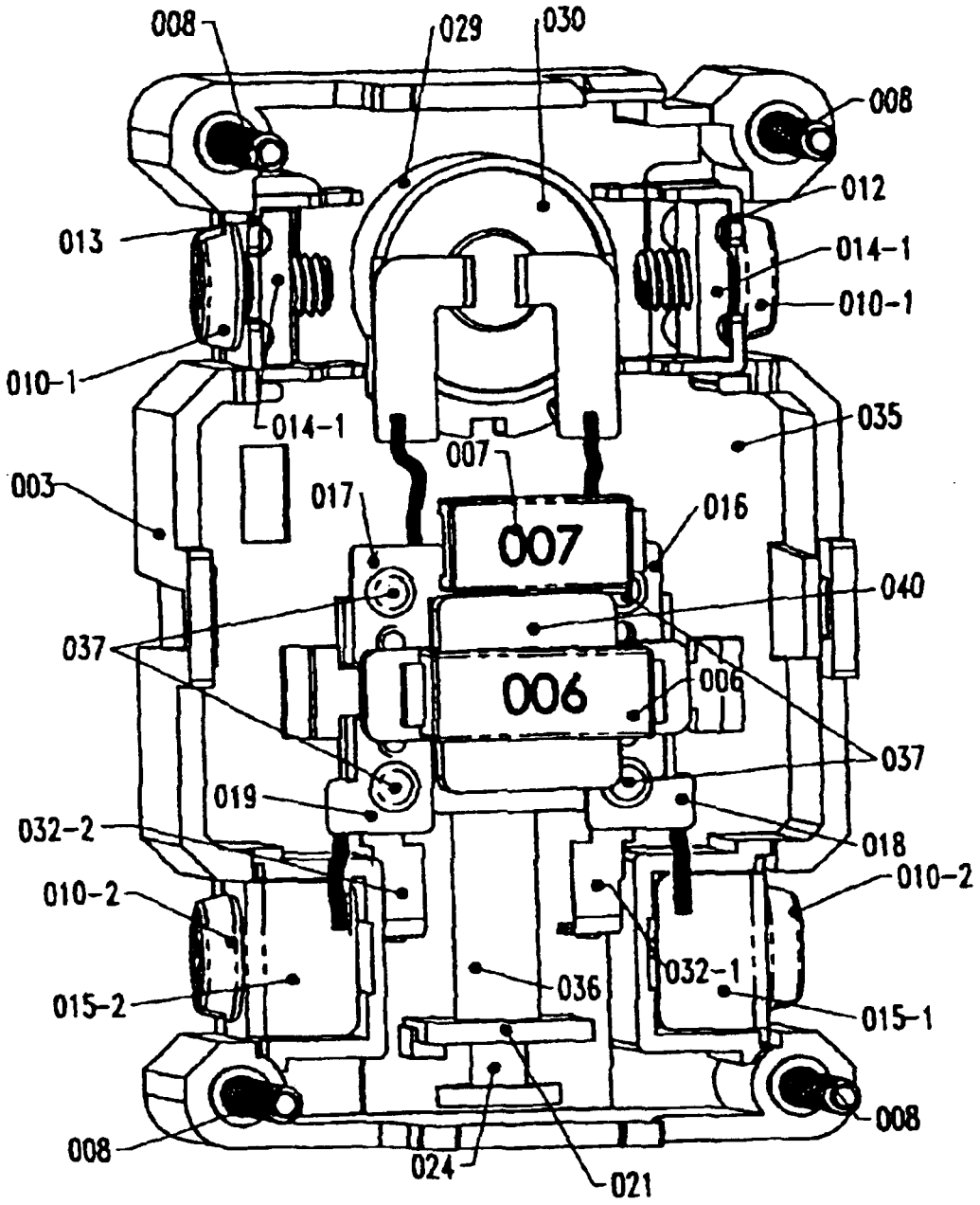
FIG. 3 is an inner structural view of the interrupter shown in FIG. 2-1 and FIG. 2-2 with its middle frame removed.
Figure 12:
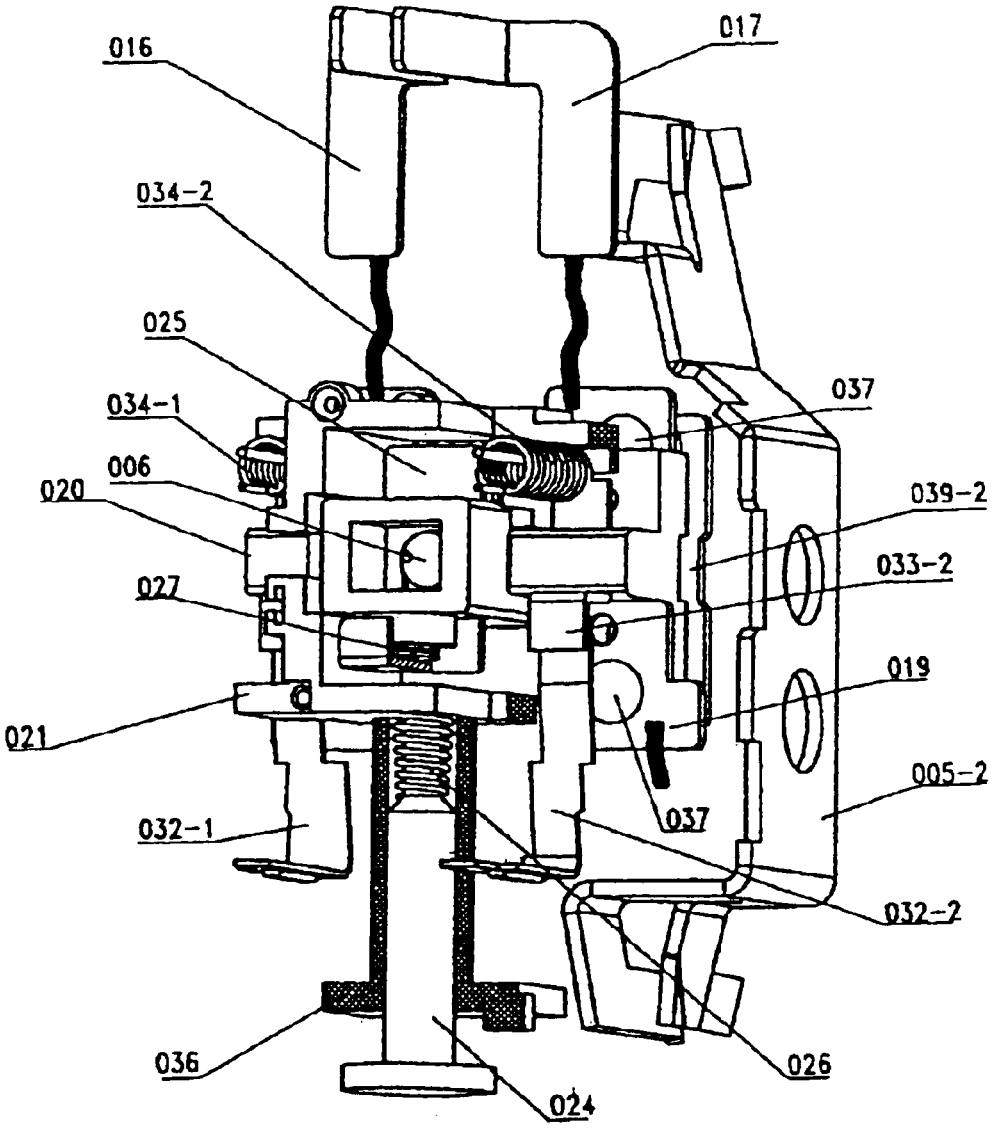

FIG. 12 is a bottom view of the interrupter shown in FIG. 3 with the following parts removed: base 003, circuit board 035, two assembly parts for input and load ends, magnetic ring sleeve 029 and magnetic ring lid 030.

Figure 13:
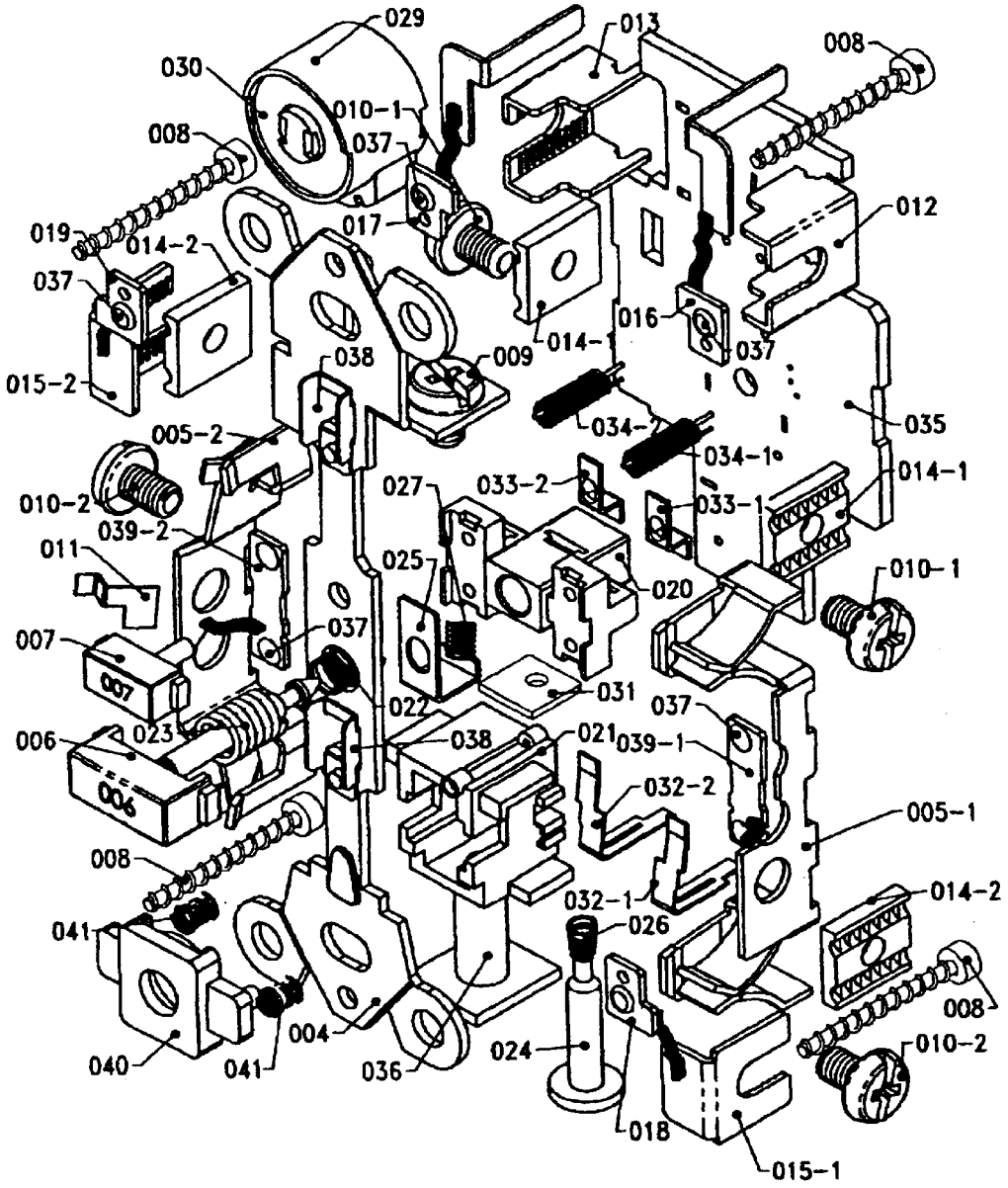

FIG. 13 is a schematic view showing the disassembled parts of the interrupter of the invention.

DETAILED DESCRIPTION OF PREFERRED EMBODIMENTS

Next, a detailed description of the structure of the circuit interrupter according to the invention will be given in below taken in conjunction with accompanying drawings described above.

Figure 1:
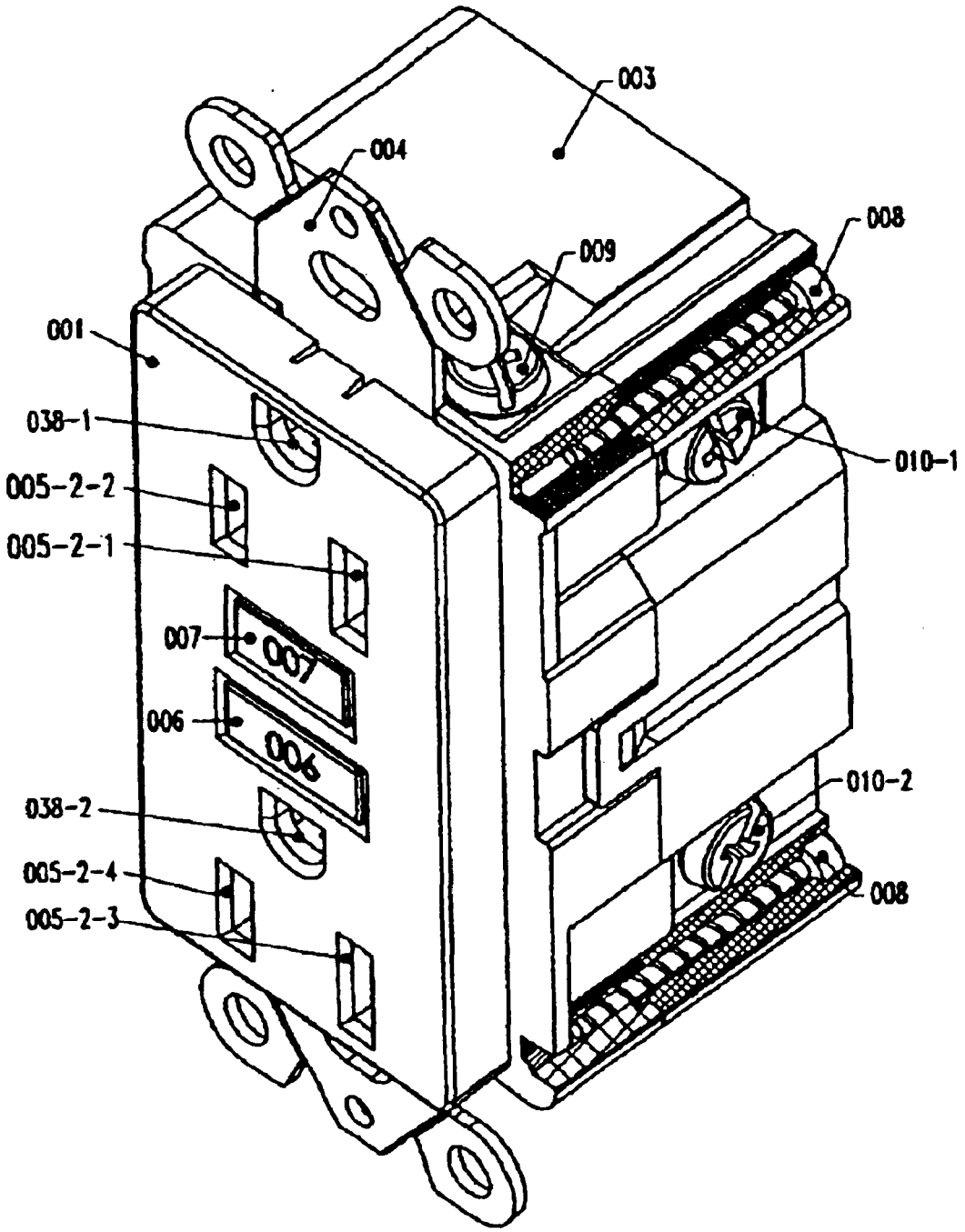
FIG. 1-1 is an outside structural view of the circuit interrupter of the invention for input current of 15 amperes.
Figures 1, 2:
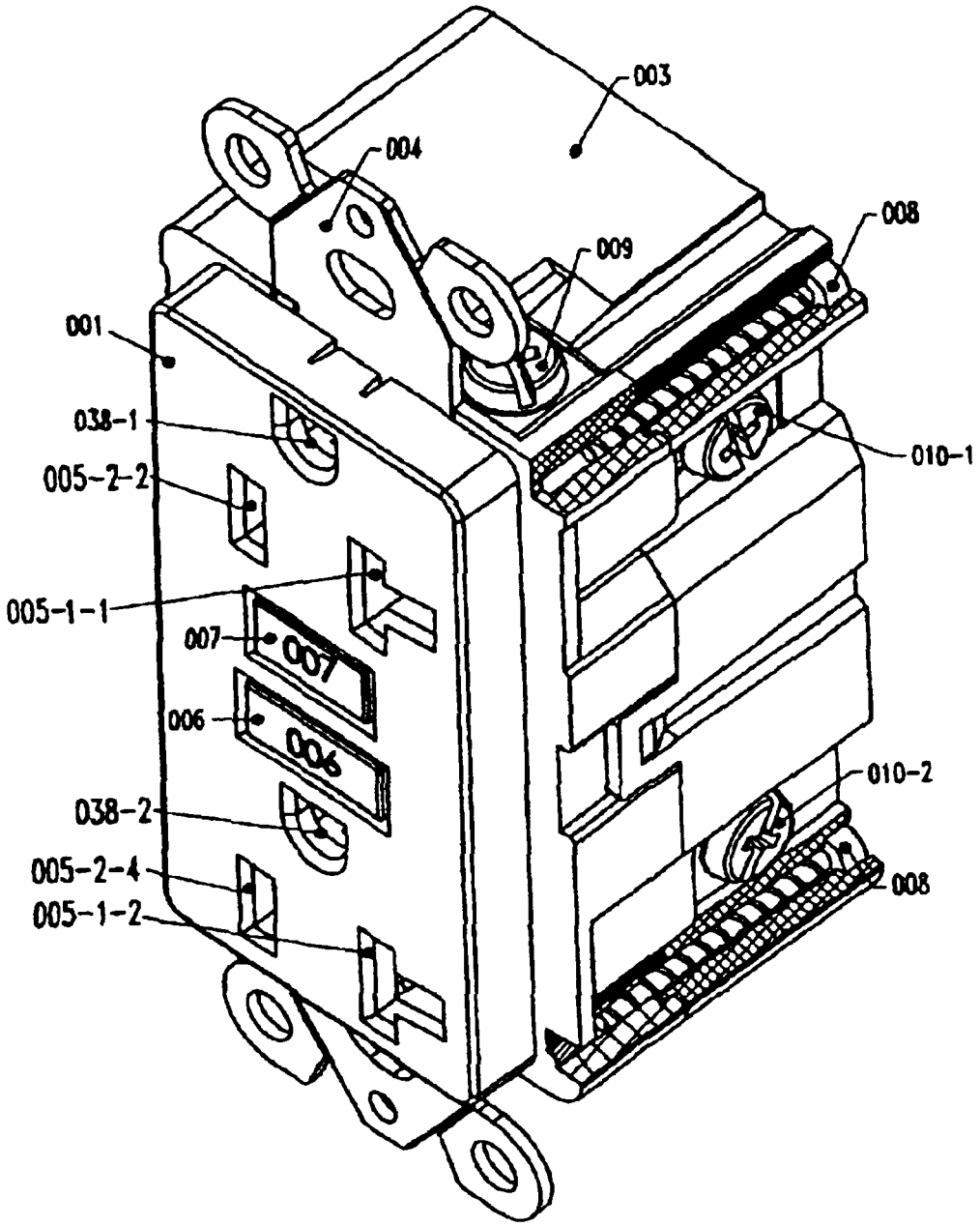
Figures 1, 2:
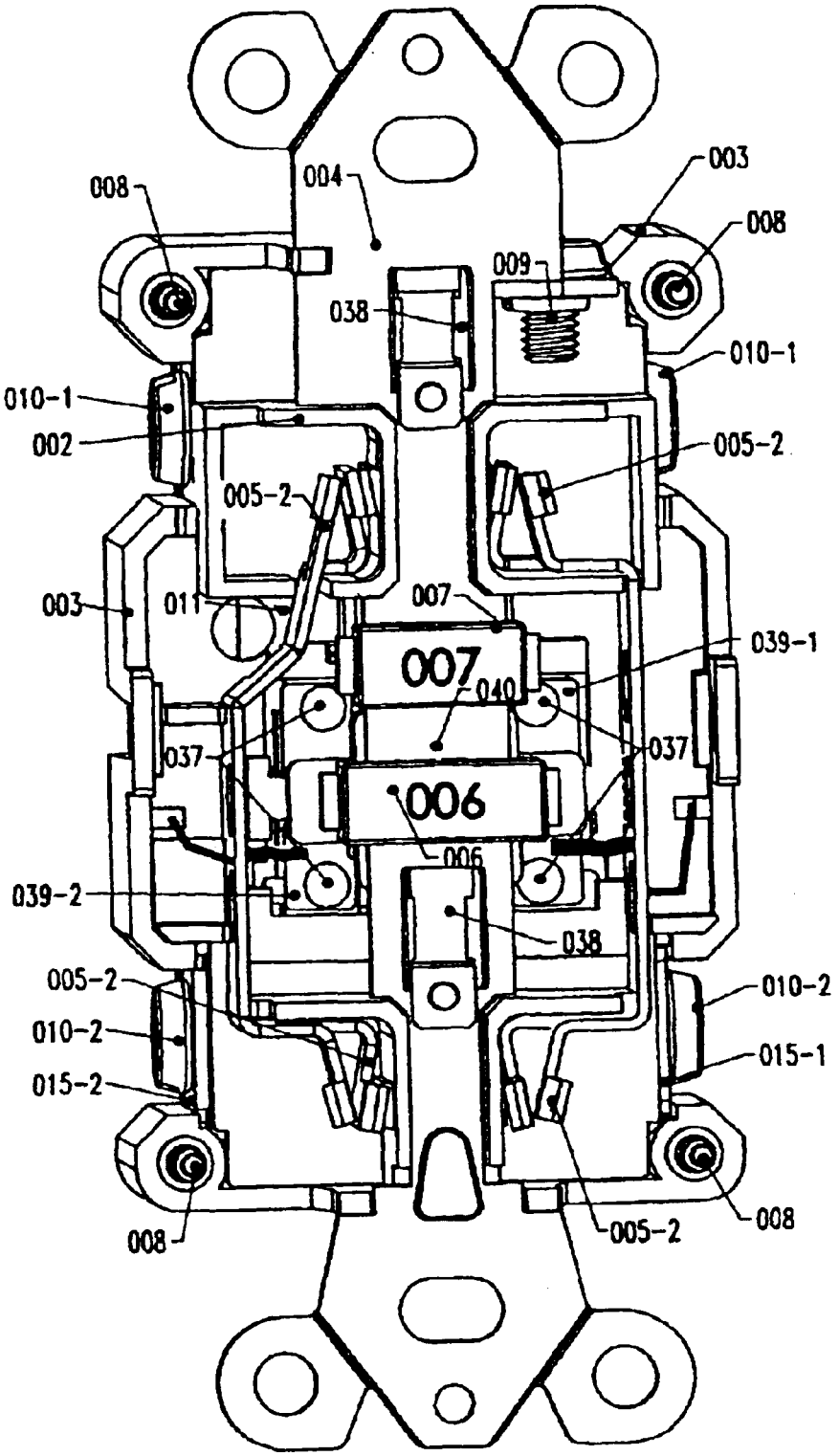
Figure 2:
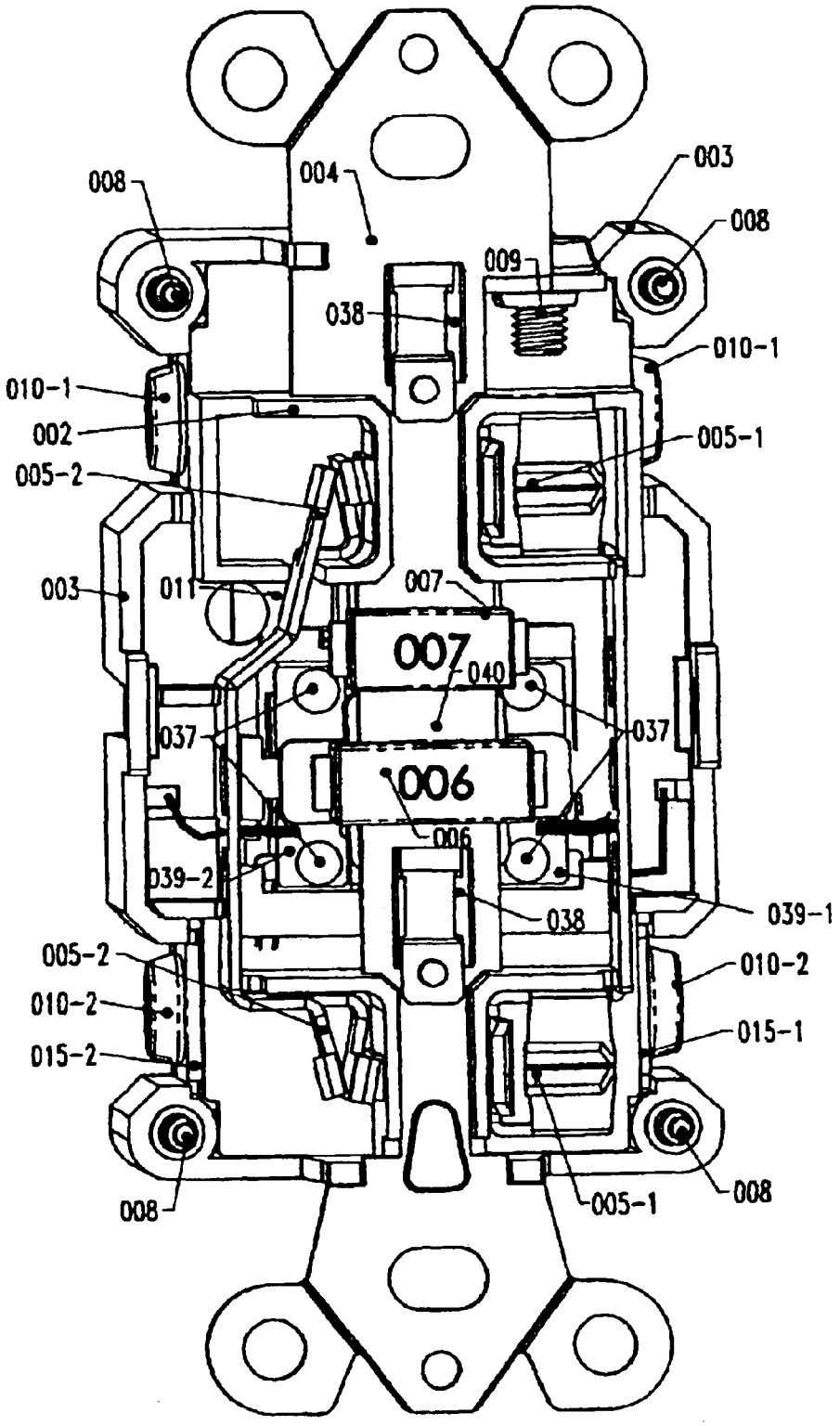

There are two power ratings for the circuit interrupter of the invention: the 15 A rating shown in FIG. 1-1 and the 20 A rating shown in FIG. 2-1.

For both interrupters shown in FIG. 1-1 and 1-2, the outer case, upper lid 001, base 003 and the grounding bracket 004 are connected together by four assembling screws 008 at the four corners. There are the reset button 006 and the test button 007 installed inside lid 001, the input end wire connection screws 010-1 and load end wire connection screws 010-2 installed on base 003, and the grounding bracket 004 between lid 001 and base 003, on which is installed the grounding screw 009. On the upper lid 001 shown in FIG. 1-1 there are four 15 A socket static contact conducting insertion inlet 005-2-2, 005-2-3 and 005-2-4. On the upper lid 001 shown in FIG. 1-2, there are two 20 A socket static contact conducting insertion inlet 005-1-1, 005-1-2 and two 15 A socket static contact conducting insertion inlet 005-2-2 and 005-2-4. There are two grounding insertion holes 038-1 and 038-2 on every upper lids 005. There may be some indicating light on the upper lid 001 but it is not shown on upper lid 001 in FIG. 1-1 and FIG. 1-2.

The FIG. 2-1 and FIG. 2-2 are respectively those views of FIG. 1-1 and FIG. 1-2 with upper lid 001 removed in order to show the inner structure and in particular to show the assembling screws 008 at the four corners and the fact that the middle frame 002 is placed within the base 003. FIG. 2-1 shows the two socket static contact conducting parts 005-2 of the 15 A interrupter. FIG. 2-2 shows the socket static contact conducting piece 005-1 for use on 20 A and one socket static contact conducting piece 005-2 for use on 15 A interrupters. Shown in this figure there are rounding pieces 038 and the grounding screw 009 respectively placed on the two ends of the grounding bracket 004. On the socket movable contacts 039-1 and 039-2 are respectively two silver contact points 037 and the test experiment sheet 011 below the test button 007. Under the load end wire connection screws 010-2 are the load end wire connection sheets 015-1 and 015-2 which may or may be not connected with the two mentioned socket static contact conducting pieces 005-1 and 005-2 respectively. When the sheets 015-1 and 015-2 are not connected with the conducting pieces 005-1 and 005-2 respectively the load end wire connection sheet has no electricity and when otherwise, it has electricity. Shown in FIG. 2-1 and FIG. 2-2, the sheets 005-1 and 005-2 are not in contact with the two load end wire connections 015-1 and 015-2.

FIG. 3 is the inner structural view of the interrupter shown in FIG. 2-1 and FIG. 2-2 with its middle frame 002 removed. On inner bottom of the base 003 there is placed the circuit board 035 on which are placed the magnetic ring sleeve 029 with magnetic ring inside and the magnetic ring lid 030. Two input ends contain respectively the wire connection screws 010-1, the input end wire connection pieces 012 and 013, the input end wire connection cover plate 014-1 and the two input movable contact heads 016 and 017 which have wires connected in the middle and have one end inserted into magnetic ring lid 030. The purpose of contacts 016 and 017 are for the increase of electric conduction capability. The two load ends contain respectively the wire connection screw 010-2, load end wire connection pieces 015-1 and 015-2 and the two load end movable contacts 018 and 019 which are connected respectively to two load end wire connection pieces 015-1 and 015-2 by wires. There are placed between the two movable contacts 018 and 019 a trip winding bracket 021 on which are placed the trip winding 036 with trip armature 024 inside. On the sides of the trip winding 036 are placed the reverse direction trip static contact heads 032-1 and 032-2.

Figure 4:
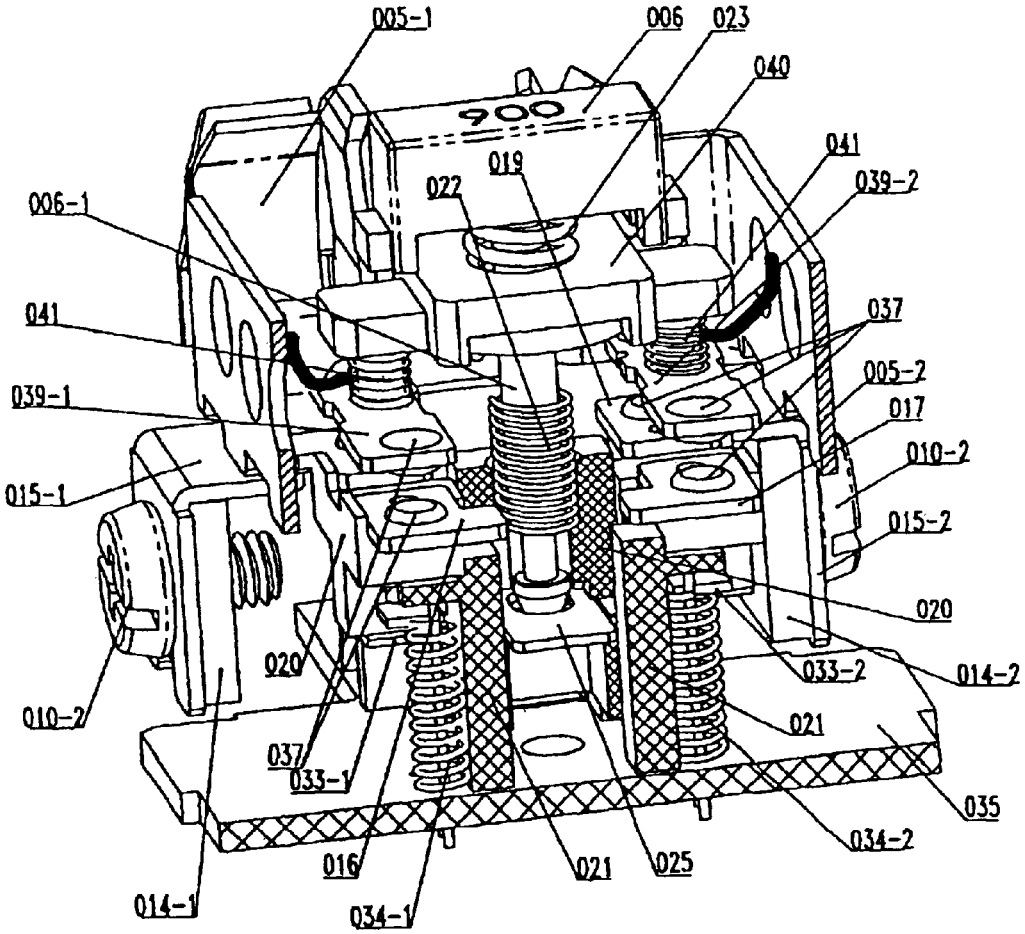
FIG. 4 is an cross sectional view of the interrupter shown in FIG. 6 with its base 003 removed.

FIG. 4 is the cross sectional view of the interrupter shown in FIG. 3 with its base 003 removed, which shows the inner structure of the reset trip device. On the upper part of the lock pin armature 006-1 with a conical tip below the reset button 006 is hooked with the reset spring 023 and on the lower part of the armature 006-1 is hooked with a trip assisting spring 022. On the conical tip is a reset trip lock pin 025. Two reverse direction trip load end conducting springs 034-1 and 034-2 are placed on both sides of the winding bracket 021, one end of which is fixed on the circuit board 035 while the other end is fixed respectively with the reverse direction trip movable contacts 033-1 and 033-2. Placed under the reset button 006 are the socket contact positioning bracket 040 on both sides of which are placed respectively the socket contact positioning springs 041 under which, in turn are placed respectively the socket movable contacts 039-1 and 039-2 which are connected by wires to the two socket static contact conducting pieces 005-1 and 005-2 respectively.

Figure 5:
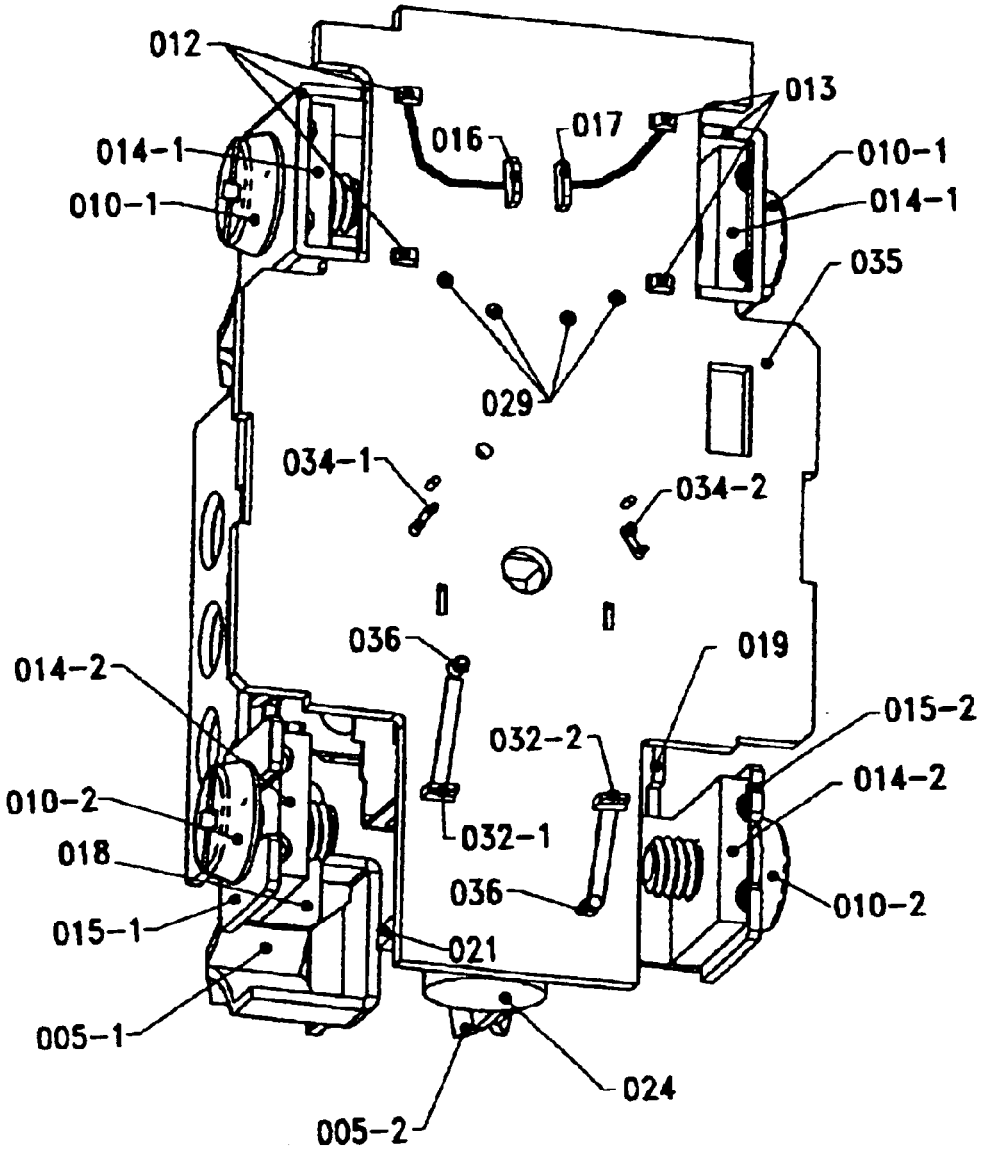
FIG. 5 is an bottom view of the interrupter shown in FIG. 3 with its base 003 removed.

FIG. 5 is the bottom view of the interrupter shown in FIG. 3 with its base 003 removed showing the positions where various reverse conducting components on the circuit board 035 are placed and how their wire connections are made. FIG. 5 also shows the position where the two reverse trip load end conducting springs 034-1 and 034-2 are connected to the circuit board 035. The two reverse trip static contacts 032-1 and 032-2 are connected respectively with the trip winding 036 One end of either two input end wire connection pieces 012 and 013 are respectively connected with the two input end wire connection pieces 012 and 013, and there is a leg position diagram of the magnetic ring sleeve at the space between 012 and 013.

Figure 6:
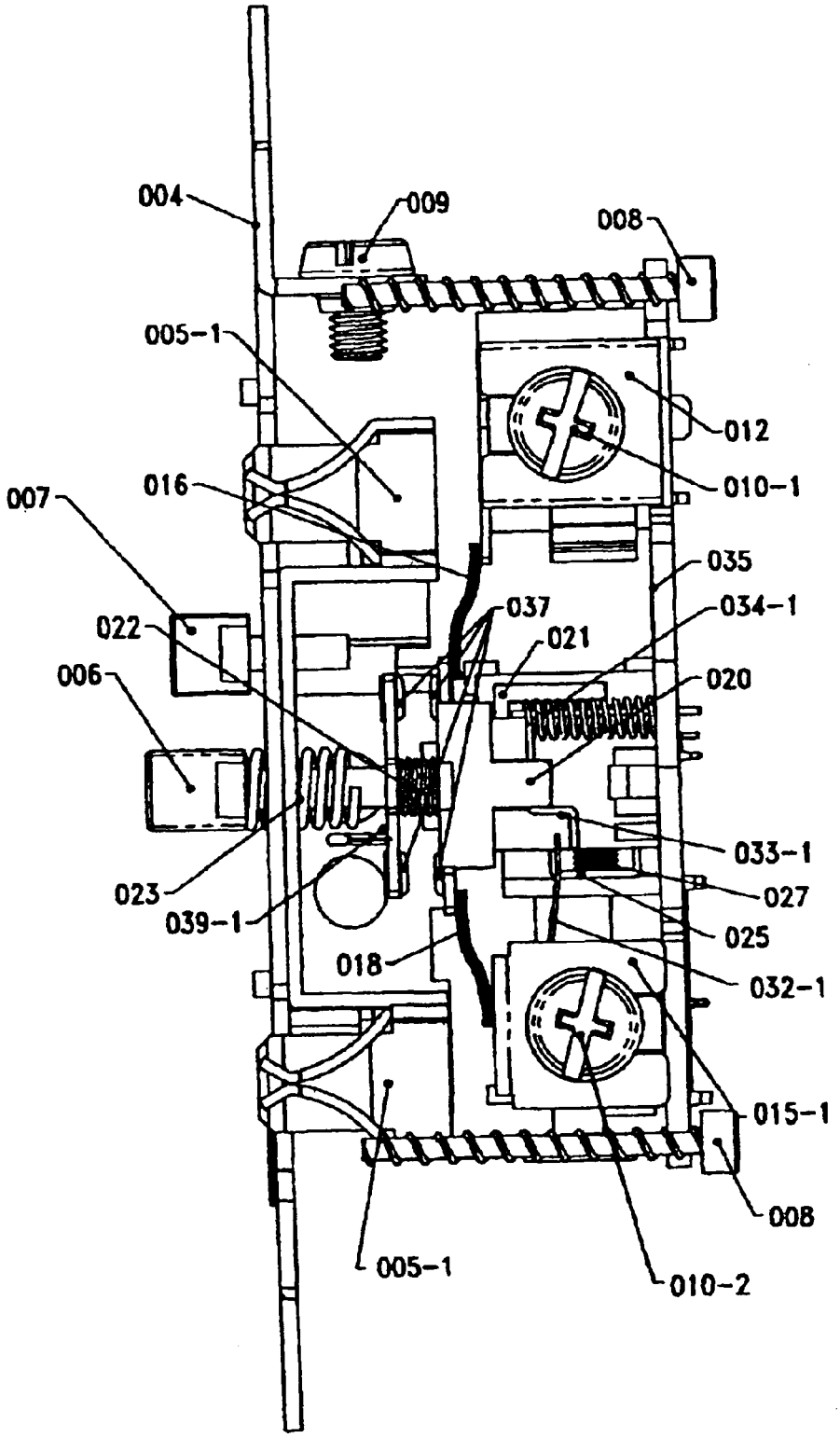
FIG. 6 is an dissected view of the interrupter showing the triped situation.

FIG. 6 is the dissected view of the interrupter showing the triped situation. Here, the reset button 006 is situated in the trip state and one end of the reverse trip mobvable contact 033-1 is being attracted by the reverse trip load end conducting spring 034-1 and these two are in contact, while the other end of 033-1 breaks from the reverse static contact head 032-1.

Figure 7:
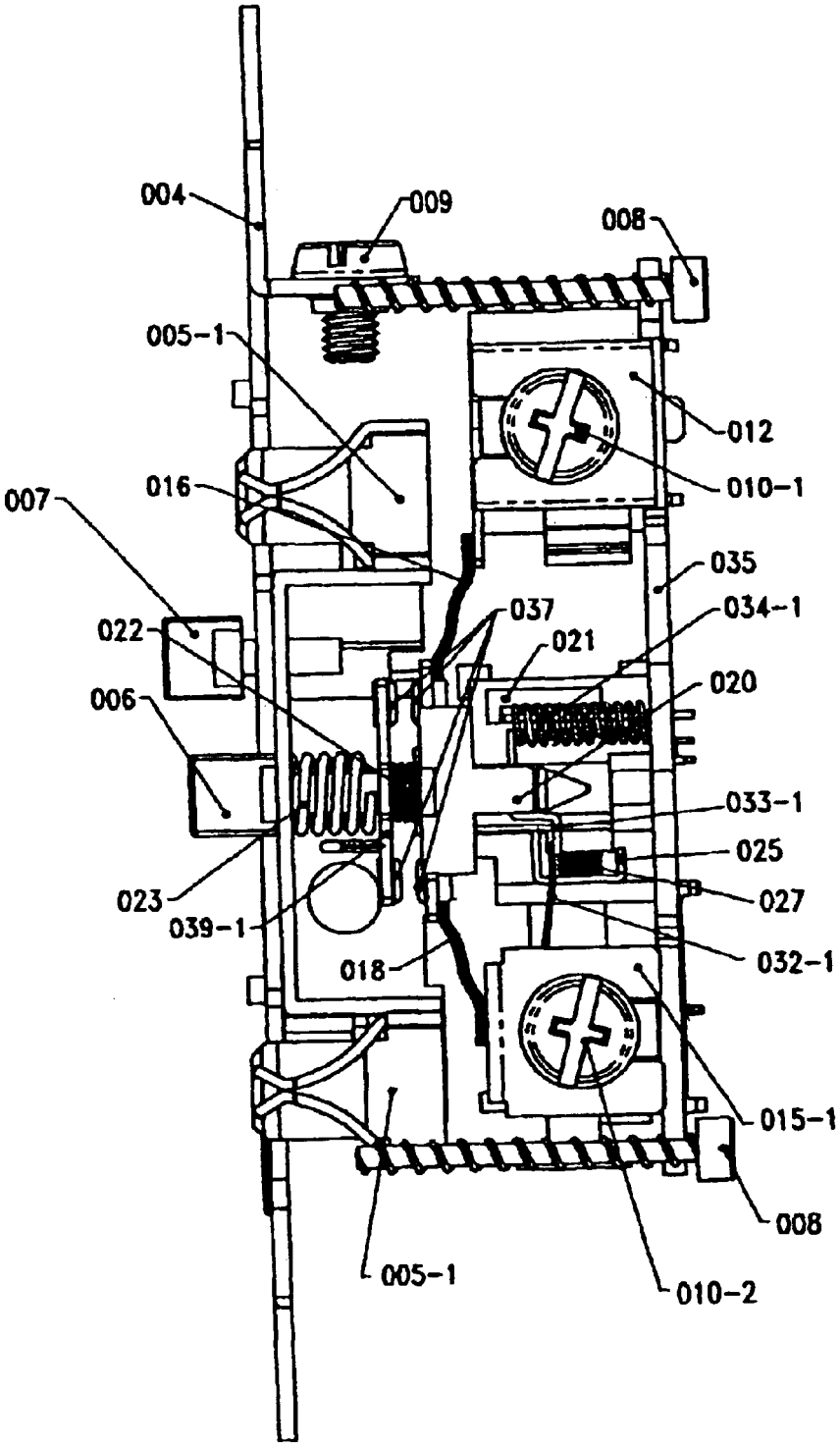

FIG. 7 is the schematic view showing the situation when reverse conduction is on. Here, the reset button 006 is pressed down and its lock pin armature is being locked by the reset trip lock pin 025. The reset trip device 020 is raised up by resilience of the reset spring 023, causing the contact 033-1 to touch with the conducting spring 034-1 and the static contact 032-1. Now the anti-RCE mechanism is situated in the "on" state. There is no connection between the movable contacts of input and load end 016 and 018 and the socket static contact conduction pieces 005-1, so the socket is free of electricity.

Figure 8:
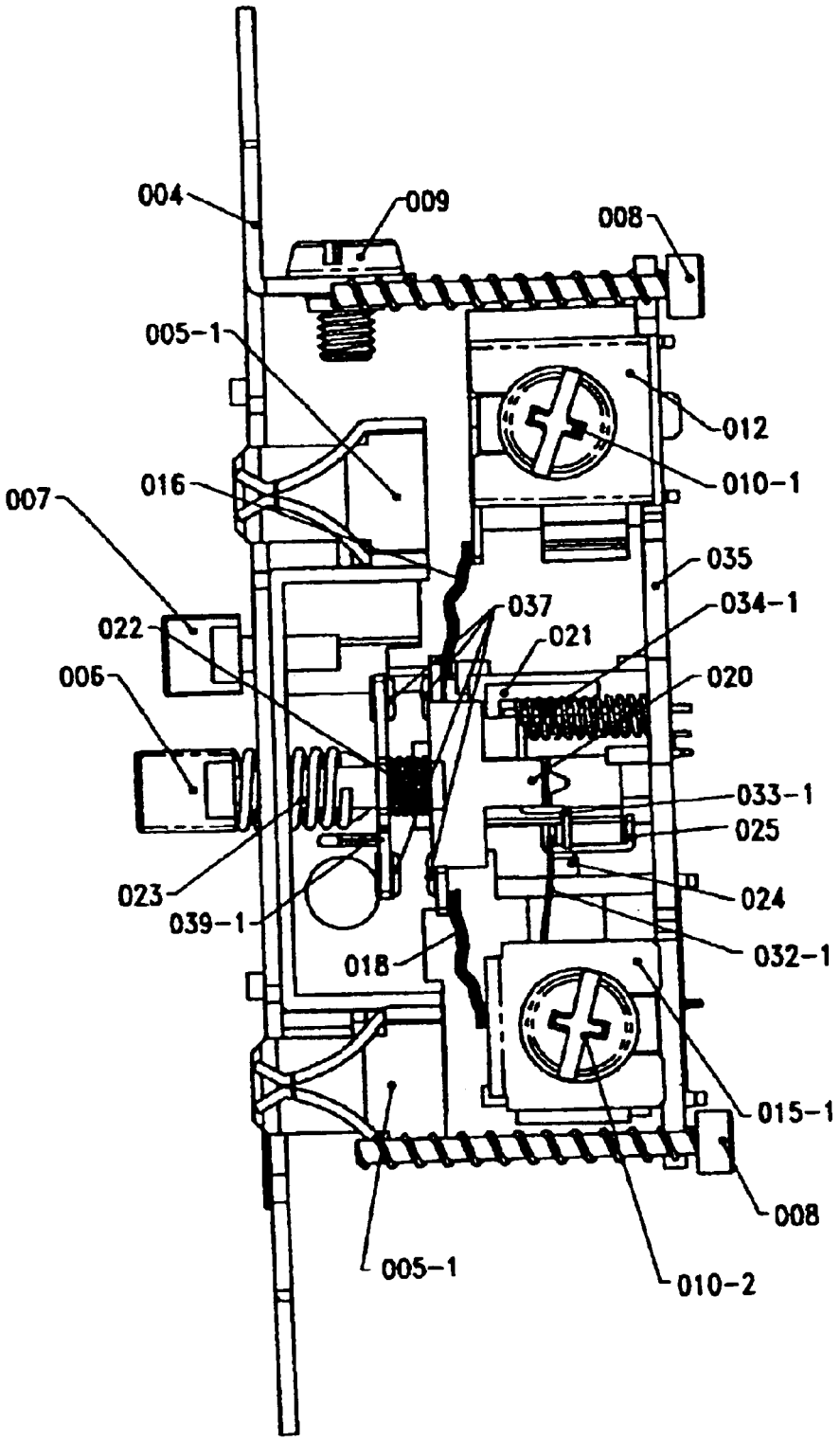
FIG. 8 is a schematic view showing the electric cut off situation of the erroneous reverse connection mechanism.

In FIG. 8, when the anti-RCE mechanism is in the "on" state as shown in FIG. 7, the trip winding 036 is excited immediately like a blitz by power "off" changed from "on" state, and begins to act, Therefore, the trip armature 024 acted upon by magnetic force begins to compress the reset spring 026, pushing open the link-release lock pin 025, causing reset button 006 to separate from lock pin 025, thus the trip assisting spring 022 immediately resiles. The trip device 020 under the action of resilence returns to the original position and drives the reverse trip movable contacts 033-1 and 033-2 to move downward and break from the reverse trip static contact 032-1 and 032-2. Now the anti-RCE mechanism is situated in the "off" state.

Figure 9:
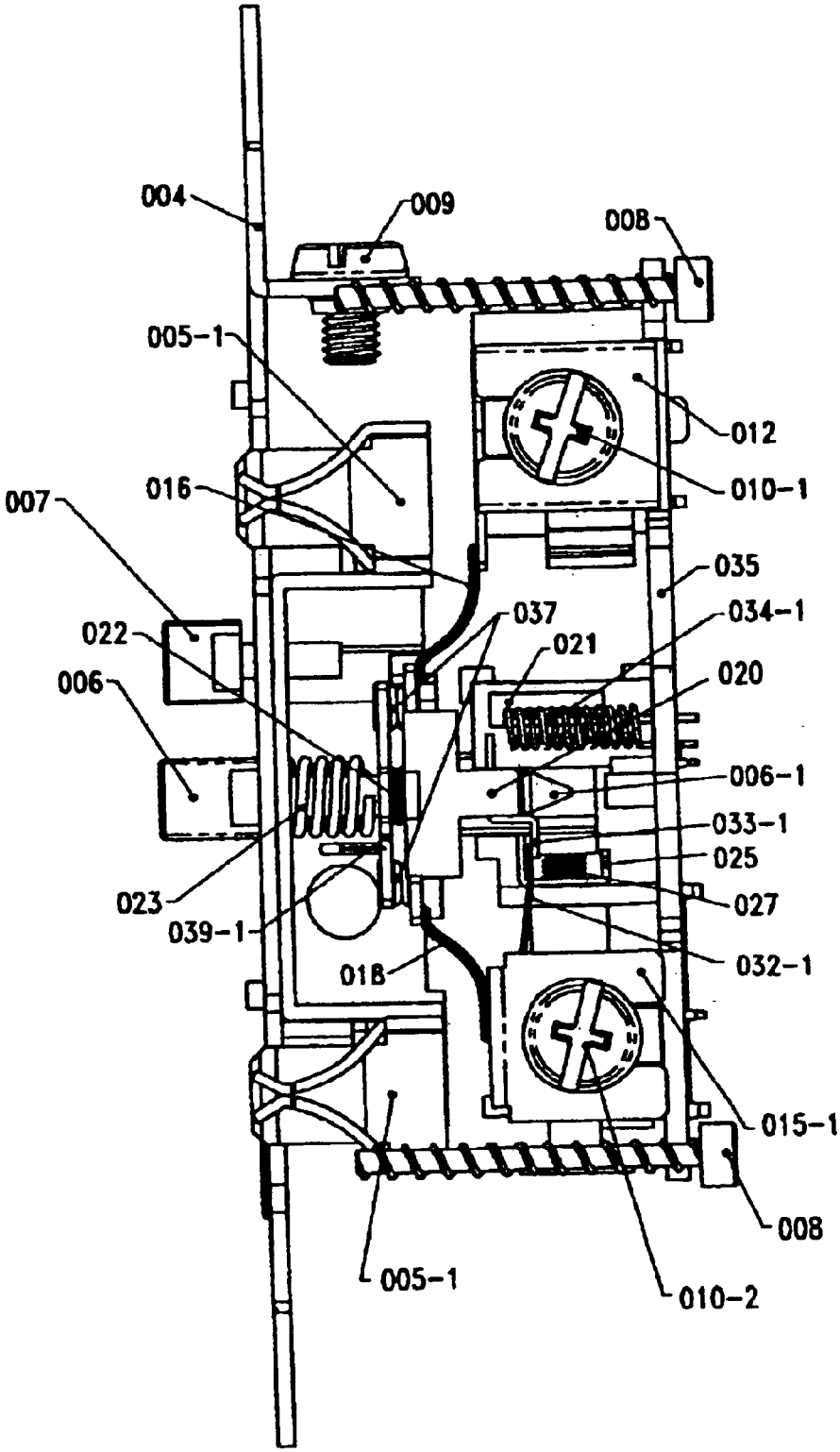
FIG. 9 is a schematic view showing the electric conduction state after reset of the interrupter with power source connected at its input end.

FIG. 9 is the schematic view showing the electric conduction state after reset of the interrupter with power source connected at its input end.

When power is connected to the input end and reset button is pressed down, reset trip lock pin 025 is opened, the lock armature 006-1 is locked by lock pin 025 and reset spring 023 begins to resile to push upward which drives reset trip device 020 to move up and the movable contacts of input 016, 017 and load end 018, 019 move up simultaneously with the device 020 and make contact with socket static contact conducting pieces 005-1 and 005-2 thus completing the connection of power to the load end of the interrupter. Now the anti-RCE mechanism is situated in the "off" state and will absolutely not affect the normal function of the interrupter.

Figure 10:
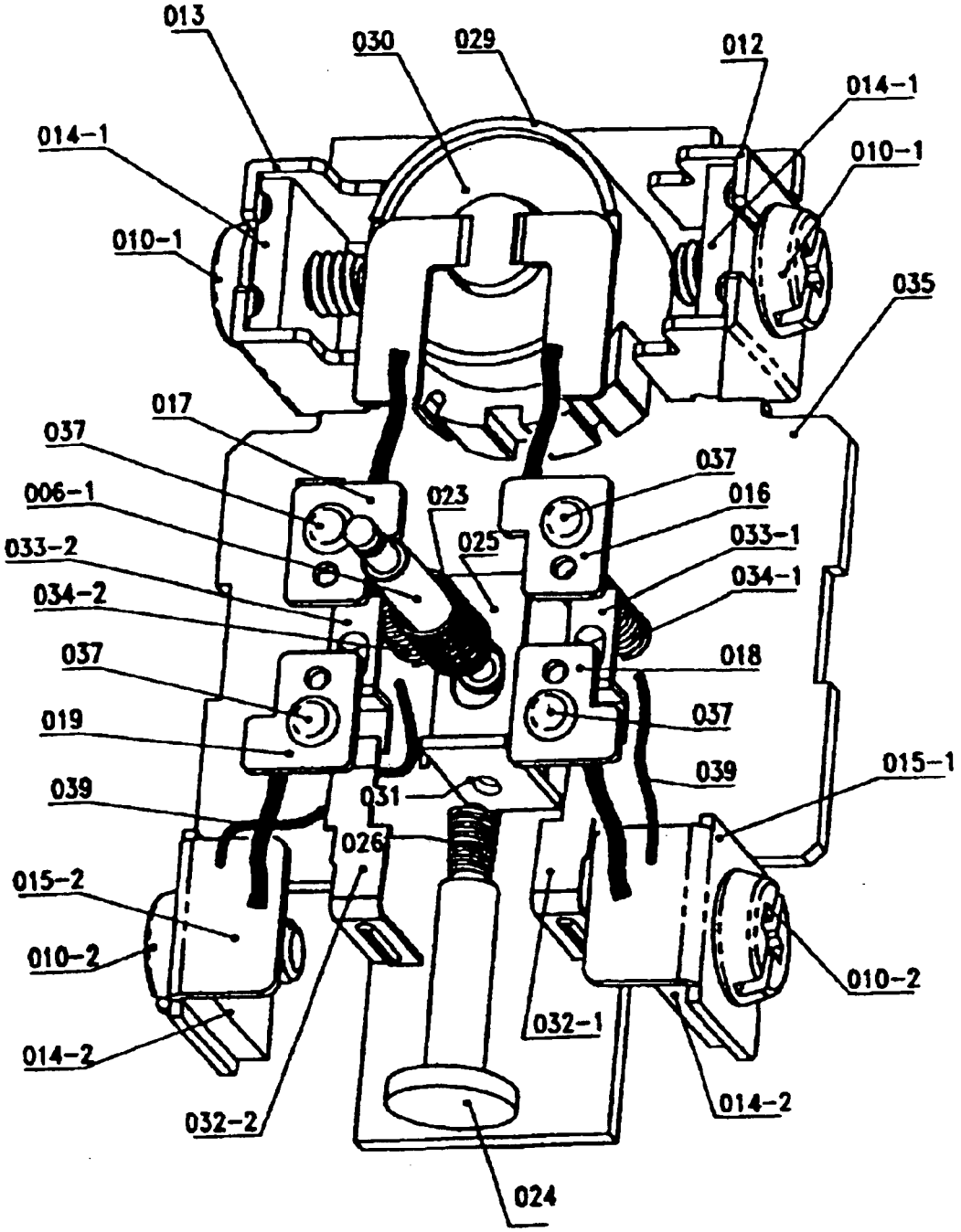
FIG. 10 is a schematic view showing the reverse trip mechanism and the reverse erroneous connection mechanism.

FIG. 10 is the schematic view showing the reverse trip mechanism and the erroneous reverse connection mechanism.

FIG. 10 further shows the positions of the various components in the reverse trip mechanism and erroneous reverse connection mechanism. In the erroneous reverse connection mechanism, the load end movable contacts 018 and 019 connect reverse trip load end conducting spring 034-2 or 034-1 which are put under the reverse direction trip movable contacts 033-2 or 033-1 in the reset state thru the reverse conducting wire 039. In the reverse trip mechanism, one end of the trip armature reset spring 026 is hooked on the head of the trip armature 024 while the other end is pushed against the trip winding magnetic pole piece 031.

Figure 11:
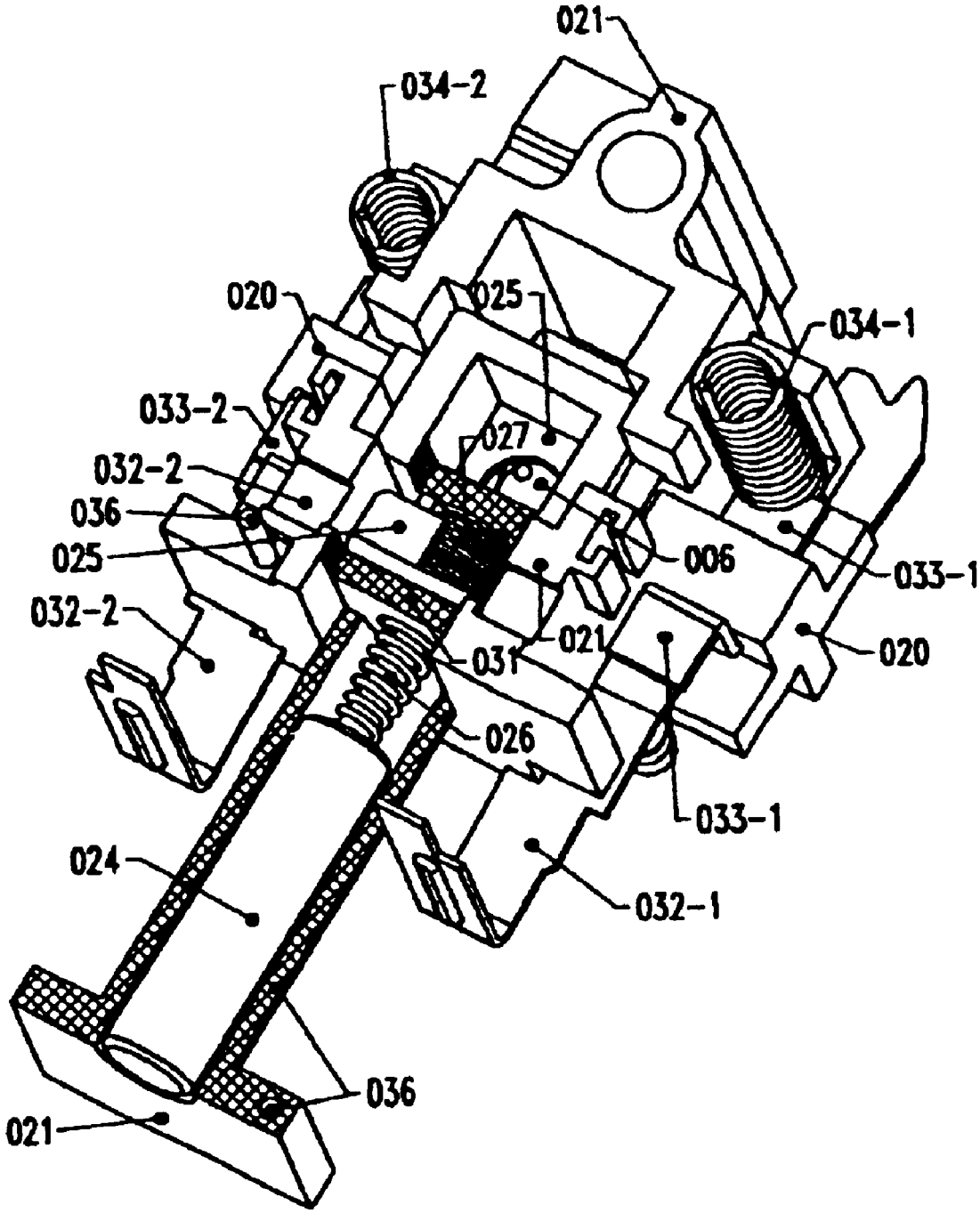
FIG. 11 is a bottom view of the interrupter shown in FIG. 10 with circuit board 035 removed.

FIG. 11 is the bottom view of the interrupter shown in FIG. 10 with circuit board 035 and the two moveable contacts of input and load end removed. FIG. 11 is used mainly to show the positions of various trip elements in the reverse trip mechanism. At the central position of trip device 020 opposite to reset button 006 there is placed trip lock pin 025 which contains at its inside the reset lock pin spring 027. The trip winding magnetic pole piece 031 is located between lock pin spring 027 and armature reset spring 026. The two reverse trip movable contacts 033-1 and 033-2 are placed on the top of the reverse direction trip load end conducting spring 034-1 and 034-2 through the trip device 020 respectively.

FIG. 12 is the bottom view of the interrupter shown in FIG. 3 with the following removed: base 003, circuit board 035, the assembly parts for two input and load ends, magnetic ring sleeve 029 and magnetic ring lid 030. FIG. 12 shows more clearly the shape and relative positions of the input end movable contacts 016 and 017 of the anti-RCE mechanism, the socket static contact conducting piece 005-2, the reverse trip contacts 032-1 and 032-2 and the reset trip device 020. The trip winding 036 of the trip armature 024, the trip armature reset spring 026 and the reset lock pin spring 027 are successively placed on the trip winding bracket 021.

In FIG. 13, structure and shape of all components used in the interrupter of the invention are shown.

Although the preferred embodiment of the invention have hereinbefore described, the invention is nonetheless limited only by the following claims.

What is claimed is:

1. A ground fault circuit interrupter providing protection against reverse connection error (RCE), comprising an outer case consisted of a base (003), a middle frame (002), an upper lid (001) on which is installed a reset button (006) and a test button (007), a grounding frame (004), two input ends and two load ends, and two socket static contact conducting parts (005-1, 005-2), wherein the said two input ends include respectively an input end movable contact (016, 017) connected by wire, the said two loads end include respectively a movable contact (018, 019) connected by wire and an erroneous reverse connection mechanism, said reset button (006) including a reverse trip mechanism, wherein the said erroneous reverse connection mechanism includes two load end wire connection parts (015-1,015-2), two reverse wires (039) and two reverse trip load end conducting springs (034-1, 034-2), said wire connection parts (015-1, 015-2) are connected to the conducting springs (034-1, 034-2) respectively by the reverse conductors (039).

2. A ground fault circuit interrupter providing protection against reverse connection error (RCE), comprising an outer case consisted of a base (003), a middle frame (002), an upper lid (001) on which is installed a reset button (006) and a test button (007), a grounding frame (004), two input ends and two load ends, and two socket static contact conducting parts (005-1, 005-2), wherein the said two input ends include respectively an input end movable contact (016, 017) connected by wire, the said two loads end include respectively a movable contact (018, 019) connected by wire and an erroneous reverse connection mechanism, said reset button (006) including a reverse trip mechanism, wherein the said reverse trip mechanism within the reset button (006) comprises two reverse trip static contacts (032-1, 032-2), two reverse trip movable contacts (033-1, 033-2), a reset trip device (020), a trip winding bracket (021), a trip winding (036) including a trip armature (024) placed successively upon the trip winding bracket (021), a reset trip spring (026), a trip winding magnetic pole piece (031), and a reset trip lock pin (025) including a reset lock pin spring (027) inside it, the said two reverse trip static contacts (032-1, 032-2) are placed respectively on the both sides of the trip winding bracket (021) and the reverse trip movable contacts (033-1, 033-2) are placed on the reverse trip load end conducting springs (034-1, 034-2) through the reset trip device (020).

3. The ground fault circuit interrupter against RCE according to claim 1, wherein said middle frame (002) is separately placed in the space between the upper lid (001) and the base (003), or is placed inside the base (003).

4. A ground fault circuit interrupter having protection against reverse connection error (RCE), comprising:

a housing;

a grounding frame disposed at least partially within said housing;

two input terminals disposed at least partially within said housing to connect said ground fault circuit interrupter with a source of electricity;

two load terminals disposed at least partially within said housing to connect said ground fault circuit interrupter with at least one load;

two input end movable contacts, each associated with and coupled to a respective one of said input terminals;

two load end movable contacts, each associated with and coupled to a respective one of said load terminals;

two socket movable contacts, each associated with and coupled to a respective side of an electrical socket disposed within said housing, each further to make contact with a respective one of said input end movable contacts and a respective one of said load end movable contacts when in a first state; and a reverse connection error mechanism to cause said socket movable contacts to not make contact with their respective input end and load end movable contacts when a reverse connection error occurs.

5. The ground fault circuit interrupter of claim 4, wherein said housing comprises:

a base;

a middle frame; and an upper lid.

6. The ground fault circuit interrupter of claim 4, wherein each said respective side of said electrical socket comprises at least one static socket conducting part.

7. The ground fault circuit interrupter of claim 4, wherein said reverse connection error mechanism is coupled to a reset button at least partially disposed within said housing.

8. The ground fault circuit interrupter of claim 7, further comprising:

at least one socket contact supporter coupled to said reset button and to said movable socket contacts.

9. The ground fault circuit interrupter of claim 8, wherein each said socket contact supporter is arranged to cause at least one movable socket contact to make contact with a respective one of said input end movable contacts and a respective one of said load end movable contacts when in a first state and to maintain said at least one movable socket contact in a position in which is does not make contact with said respective one of said input end movable contacts and said respective one of said load end movable contacts when in a second state.

10. The ground fault circuit interrupter of claim 7, wherein said reverse connection error mechanism comprises:

a reverse trip mechanism coupled to said reset button.

11. The ground fault circuit interrupter of claim 10, wherein said reverse trip mechanism comprises:

two reverse trip static contacts; and two reverse trip movable contacts, each associated with a respective one of said reverse trip static contacts and arranged to make contact with its associated reverse trip static contact when said reset button is pushed when a reverse connection error is present.

12. The ground fault circuit interrupter of claim 11, wherein said reverse trip mechanism further comprises:

two conducting springs, each associated with one of said reverse trip movable contacts, each of said conducting springs coupled to one of said load terminals.

13. The ground fault circuit interrupter of claim 12, wherein said reverse trip static contacts are coupled to a mechanism to prevent said reset button from remaining in a reset position when said reset button is pushed when a reverse connection error is present.

14. The ground fault circuit interrupter of claim 13, wherein said mechanism to prevent said reset button from remaining in a reset position comprises:

a locking pin to be shifted to a non-locking position to prevent said reset button from remaining in a reset position.

* * * * *